US005799580A

United States Patent [19]

Delebassee

[11] Patent Number: 5,799,580

[45] Date of Patent: Sep. 1, 1998

[54] DEVICE FOR PRINTING FABRICS MADE OF VEGETABLE FIBERS FROM A WEB OF TRANSFER PAPER

[75] Inventor: Gilbert Delebassee, Peronne-en-Melantois, France

[73] Assignee: Sublistatic International, Henin-Beaumont, France

[21] Appl. No.: 714,101

[22] PCT Filed: Mar. 20, 1995

[86] PCT No.: PCT/FR95/00336

§ 371 Date: Nov. 27, 1996

§ 102(e) Date: Nov. 27, 1996

[87] PCT Pub. No.: WO95/25635

PCT Pub. Date: Sep. 28, 1995

[30] Foreign Application Priority Data

Mar. 24, 1994 [FR] France ..... 94 03459

[51] Int. Cl.[6] ..... B41L 35/14

[52] U.S. Cl. ..... 101/488; 101/487

[58] Field of Search ..... 101/488, 487, 101/424.1, 467, 470; 68/5 C, 5 D, 8, 903

[56] References Cited

U.S. PATENT DOCUMENTS 3,994,146 11/1976 Murase ..... 68/5 C

FOREIGN PATENT DOCUMENTS 2628676 2/1982 Germany .
2078173 1/1982 United Kingdom .

*Primary Examiner*—Edgar S. Burr
*Assistant Examiner*—Anthony H. Nguyen
*Attorney, Agent, or Firm*—Hodgson, Russ, Andrews Woods & Goodyear LLP

[57] ABSTRACT

The web of fabric (9) passes over an input roll (10) arranged substantially at the level of the upper portion of the heating drum (1), around at least half the circumference of which it winds after coming into contact with a web of transfer paper (14). The drum and the pressing roll (2) between which the webs pass are received inside one and the same closed housing (3) swept by air that becomes laden with the vapors of the transport agent, the laden air being delivered to a tank of cold water (22). The apparatus finds use in the printing of fabrics made of vegetable fibers, in particular cotton.

5 Claims, 1 Drawing Sheet

DEVICE FOR PRINTING FABRICS MADE OF VEGETABLE FIBERS FROM A WEB OF TRANSFER PAPER

BACKGROUND OF THE INVENTION

The invention relates to the printing of colours or patterns from a web of transfer paper and, more particularly, to a device for transfer to a fabric made of vegetable fibers.

A device for transfer from papers having sublimable inks thereon performs the function of placing a web of paper in contact on a web of fabric by imparting thereto a moderate pressure, in such a way that the pattern and the colours on the paper are transferred to the fabric. For this purpose, the paper comprises, in addition to the colouring agents, a transport agent which melts through the effect of heat and which dissolves the colouring agents and then entrains them into the fiber of the fabric.

However, this transport agent has the major drawback of causing a substantial release of very dense vapors during the transfer phase, which is carried out at around 200° C.; these vapors then recondense at the time of cooling and form large deposits on the surrounding floor and on the transfer machine, which represents an unacceptable inconvenience.

Transfer to a fabric made of vegetable fibers, for example cotton, thus appears to be impossible using the conventional sublimation technique.

To avoid this drawback associated with the necessary presence of this transport agent, the inventor has devoted his attention to the development of a device which associates with the transfer operation, properly speaking a complementary operation, involving the extraction of the transport agent, which thus makes it possible, without detriment to the environment, to effect transfer onto a fabric made of vegetable fibers.

SUMMARY OF THE INVENTION

A main object of the present invention thus resides in a device for printing a fabric made of vegetable fibers from a web of transfer paper bearing coloring agents and a transport agent, comprising a heating calendering drum and a pressing roll between which a web of fabric and a web of transfer paper supplied by independent payout rolls, come into contact with one another, a device in which the web of printed fabric remains in contact with the heating drum over at least half its circumference, the said heating drum and the pressing roll being received inside one and the same housing swept by air, which becomes laden with the vapors of the transport agent, the laden air being sent to a tank of cold water.

To permit this contact, the web of fabric passes over an input roll, arranged substantially at the level of the upper portion of the drum, before penetrating the enclosure and passes back over a guide roll, also outside the enclosure and arranged in the vicinity of the input roll, above the level of the lower portion of the drum.

According to one alternative form of embodiment, the transfer paper remains pressed against the fabric over a certain portion of the heating drum, beyond the point of contact with the pressing roll, and passes back over an idler roll.

To ensure air circulation, the closed housing is provided, at its lower portion, with air inlet openings and, at its upper portion, with a discharge tube, equipped with an extraction means, emerging in the tank.

Further characteristics and advantages of the invention will be more clearly perceived upon reading the following description of a non-limitative example of embodiment referring to the sole FIGURE annexed.

BRIEF DESCRIPTION OF THE DRAWING FIGURE

The single FIGURE of the drawing, FIG. 1, is a schematic elevational view of a printing device according to the present invention.

DETAILED DESCRIPTION OF THE ILLUSTRATED EMBODIMENT

Figure 1:
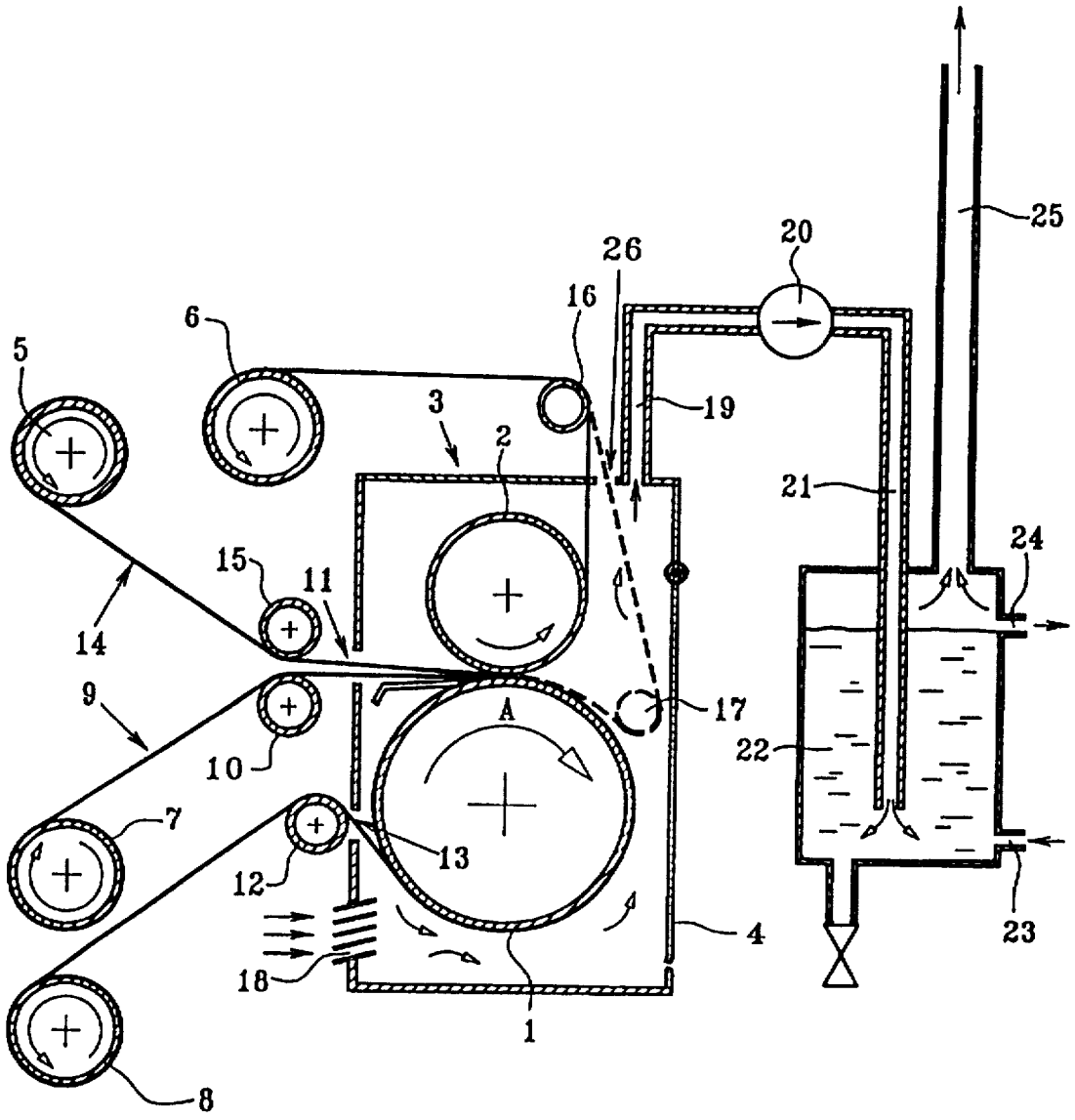

FIG. 1 shows a calendar in the form of a heating drum 1 onto which a pressing roll 2 comes to bear from above. The whole is received in a closed housing 3 accessible via an entry 4 in the form of a hinged door. Outside the housing are provided a transfer paper payout roll 5 and a roll 6 for recovery of the used paper. Similarly, below, are provided a roll 7 to pay out the fabric to be printed, for example a cotton fabric, and a roll 8 for receiving the printed fabric. The web of fabric 9 leaving the payout roll 7 passes over an input roll 10, arranged substantially at the level of the upper portion of drum 1, and then enters housing 3 through an entry slot 11. It then rolls around the heating drum and passes back via slot 13 onto another guide roll 12, also outside the container, placed in the vicinity of roll 10, which the result that the fabric is in contact with the drum over a length on the order of three quarters of the latter's circumference. Roll 12, in the position represented, is located at the level of the axis of the heating drum. In any case, it could be, constructionally, placed between any given level corresponding to the lower portion of the drum and the input roll 10, which means that, in all cases, the web of fabric would remain on the heating drum 1 over at least half of its circumference.

The transfer paper 14 supplied from roll 5 passes also over an input roll 15 placed just above roll 10 and enters the housing via a slot 11.

It is superposed upon the fabric against which it is pressed by pressing roll 2, at point A of contact with the drum. Then, it winds partially around the pressing roll and exits at the upper portion of the housing via a slot 26; it is then sent back via a guide roll 16 to the recovery roll 6. According to an alternative form of embodiment, and to ensure that the paper-fabric contact is not just at one point, but can take place over a certain portion of the drum, the transfer paper 14 returns via idler roll 17, as indicated in dashed lines.

The closed housing 3 is provided, at its lower portion, with air inlet openings 18 and, at its upper portion, with a discharge tube 19 fitted with an extraction means 20 which sends the extracted air via a conduit 21 into a tank 22 in which is ensured permanent water circulation between an inlet orifice 23 and an outlet orifice 24. The air finally escapes from the tank via a flue 25.

Thanks to this arrangement, the vapors of the transport agent are maintained in temperature in this state by the heating drum and, as applicable, by pre-heating of the air entering at 18 throughout the extraction phase. This avoids any condensation or recrystallization of the product. The vapors in question are thus discharged by the extraction means 20 and then condense upon passing through the constantly replenished volume of cold water in tank 22.

The winding of the printed fabric around a major part of the drum 1 permits total discharge of the transport agent inside the closed housing 3. The latter is completely swept by the air entering via openings 18, as well as via slots 11, 13 and 26.

FIG. 1 thus is a schematic view of the device, which can be designed differently, without departing from the scope of the invention, in particular as regards discharge of the air laden with the transport agent, and the method of bubbling it through the water tank.

I claim:

1. A device for printing on a fabric made of vegetable fibers from a web of transfer paper bearing coloring agents and a transport agent, comprising a heating calendering drum and a pressing roll between which a web of fabric and a web of transfer paper come into contact with one another, an independent payout roll for each of said webs, the web of printed fabric (9) remaining in contact with the heating drum (1) over at least half of its circumference, a closed housing, said heating calendering drum and said pressing roll (2) being received inside said closed housing (3), an air supply means and a tank of cold water, said air supply means directing air to sweep through said closed housing over the web of printed fabric, become laden with vapors and be sent into said tank of cold water.

2. Printing device according to claim 1, including an input roll (10) arranged substantially at the level of upper portion of the drum level (1) which the web of fabric passes over before entering the closed housing and a guide roll (12) outside the closed housing and arranged in the vicinity of the input roll, above the level of the lower portion of the heating calendering drum.

3. Printing device according to claims 1 or 2, including an idler roll, wherein the transfer paper (14) remains pressed against a portion of the heating calendering drum (1) beyond the point at which the fabric contacts the heating calendering drum, and then passes back over said idler roll (17).

4. Printing device according to claim 1, wherein the closed housing (3) is provided, at its lower portion, with air inlet openings (18) and, at its upper portion, with a discharge tube (19), equipped with an extraction means (20), emerging in the tank (22).

5. Printing device according to claims 1 or 4, wherein said tank (22) has an inlet orifice (23) and an outlet orifice (24) and including means to permanently supply said tank with water between said inlet orifice and said outlet orifice.

* * * * *